United States Patent [19]

Peterson et al.

[11] Patent Number: 4,941,324

[45] Date of Patent: Jul. 17, 1990

[54] HYBRID VAPOR-COMPRESSION/LIQUID DESICCANT AIR CONDITIONER

[76] Inventors: John L. Peterson, 1203 W. Creek Loop, Round Rock, Tex. 78681; John R. Howell, 3200 Kerby La., Austin, Tex. 78703

[21] Appl. No.: 405,624

[22] Filed: Sep. 12, 1989

[51] Int. Cl.[5] ..... F25B 17/00

[52] U.S. Cl. ..... 62/94; 62/271; 55/179

[58] Field of Search ..... 62/271, 94, 238.6; 55/179

[56] References Cited

U.S. PATENT DOCUMENTS

| | | | |
|---|---|---|---|
| 2,284,914 | 6/1942 | Miller | 62/271 X |
| 3,102,399 | 9/1963 | Meckler | 62/271 |
| 3,247,679 | 4/1966 | Meckler | 62/271 |
| 4,259,849 | 4/1981 | Griffiths | 62/271 |
| 4,430,864 | 2/1984 | Mathiprakassam | 62/94 |
| 4,700,550 | 10/1987 | Rhodes | 62/271 |
| 4,819,444 | 4/1989 | Meckler | 62/271 X |

OTHER PUBLICATIONS

Robison et al., "Advanced Energy Systems—Their Role in Our Future", 19th Intersociety Energy Conversion Eng. Conf., (Aug. 19-24, 1984).

Meckler, G., "Efficient Integration of Desiccant Cooling in Commercial HVAC Systems", no date.

Olsen et al., "Desiccant systems Potential for Humid Climates", no date.

Wilkinson, W. H., "Liquid Desiccant Hybrids-Complexity Made Simple", ASHRAE Transactions, 1988, vol. 94, Pt. 2.

Burns et al., "Hybrid Desiccant Cooling Systems in Supermarket Applications", ASHRAE Transactions, 1985 Winter Meeting, (Jan. 27-30, 1985).

Howe et al., "Factors Influencing the Performance of Commercial Hybrid Desiccant Air Conditioning Systems", 18th Intersociety Energy Conversion Engineering Conference, (vol. 4, 1983).

Worek, W. M. et al., "Simulation of an Integrated Hybrid Desiccant Vapor-Compression Cooling System", Energy (Oxford), vol. 11, No. 10, (Oct. 1986), pp. 1005-1021.

Kosar et al., "Supermarket Dehumidification with Gas-Fired Desiccant Systems—Field Evaluation Results", 1984 International Gas Research Conference.

Maclaine-Cross, "Hybrid Desiccant Cooling in Australia", Australian Refrigeration, Air Cond. & Heating, vol. 41, No. 5, (May 1987).

*Primary Examiner*—William E. Tapolcai

*Attorney, Agent, or Firm*—Arnold, White & Durkee

[57] ABSTRACT

A hybrid air conditioning system which simultaneously dehumidifies and cools air using standard vapor-compression equipment and aqueous solutions of liquid desiccant. By using a circulating liquid desiccant and an adiabatic humidifier, a more efficient refrigerant cycle is utilized. Moreover, conditioned air can be delivered at the same temperature and absolute humidity as conventional vapor-compression systems but without overworking the compressor.

13 Claims, 2 Drawing Sheets

HYBRID VAPOR-COMPRESSION/LIQUID DESICCANT AIR CONDITIONER

BACKGROUND OF THE INVENTION

This invention relates to a vapor-compression air conditioning system embodying a liquid desiccant for simultaneously cooling and dehumidifying conditioned air.

Liquid desiccant system can provide cooling where no active cooling is available by drying the air to a level below that required for comfort conditions, exchanging heat with the ambient environment, and then injecting moisture into the system. However, desiccant systems requires low ambient wet bulb temperatures to produce the requisite cooling. In contrast, vapor-compression systems must actively cool the air below the dew point of the air entering the evaporator in order to dehumidify the air by condensation. The vapor-compression system thereby requires that evaporator temperature be driven to a level much lower than required to achieve sensible cooling.

Hybrid vapor-compression, liquid desiccant systems combine the benefit of both desiccant systems with vapor-compression systems. Hybrid systems combine active, sensible cooling inherent in vapor-compression systems with passive, latent cooling inherent in desiccant dehumidification systems. The hybrid system need not be supercooled in order to remove moisture from the system. Consequently, energy is not wasted over-conditioning the air because moisture is sorbed rather than being condensed from the air being conditioned.

Hybrid vapor-compression, liquid desiccant systems operate by sensibly cooling the air and sorbing the moisture from the air. Sensible cooling occurs by circulating compressed and expanded refrigerant between an evaporator and condenser found in a standard vapor-compression system. Dehumidification occurs by contacting air with a desiccant on mass exchange surfaces. The mass exchange surfaces are sprayed with a liquid desiccant as outdoor air, air returning from the conditioned space, or a mixture of both, are drawn or blown through the mass exchange surfaces. The mass exchange surfaces described in prior art are separated from the heat exchange surfaces of the vapor-compression system. Conventional mass exchange surfaces often require a separate heat exchange surface for pre-cooling or pre-heating desiccants prior to being sprayed into the mass exchanger. The problems associated with separate heat and mass transfer surfaces are increased costs required to purchase separate heat and mass exchangers and reduced thermal and mass transfer efficiencies.

In the dehumidification process, moisture is sorbed from conditioned air by spraying and cooling a desiccant contacting the air in a sorbing mass exchanger or sorber. Water is sorbed in direct contact with sprayed droplets of desiccant entrained with air or on falling films of desiccant covering part or all of the mass exchange surface of the sorber. Conventional spraying techniques are inefficient methods for dehumidifying air because spraying creates an adiabatic sorbing process which increases the temperature of the sorbent, thereby reducing mass transfer. Thus, conventional spraying means require cooler exchange surfaces and produce a less efficient system because cooling is required to remove the heat of condensation, the heat of solution, and the sensible heat transferred from the air being conditioned. Conventional hybrid system waste energy by also having to transfer heat by heat exchange means external to the heat exchanger surfaces of the vapor-compressor system, or by circulating the desiccant through the heat exchange surfaces of the vapor-compression system.

During heat exchange, the desiccant solution is diluted with water and falls by gravity to a sump or reservoir placed within or below the sorber. To maintain a dehumidification process, the diluted desiccant must be desorbed, i.e., regenerated. Regeneration accomplished by spraying and heating the diluted desiccant in contact with air expelled from a desorbing mass exchanger or desorber. Consequently, a portion of the diluted desiccant in the sump of the sorber is pumped to the desorber for concentration. Water is desorbed from the sprayed droplets of desiccant entrained with air or by falling films of desiccant covering part or all of the mass exchanger surfaces of the desorber. Heating is required to provide the heat of vaporization necessary to evaporate water from the desiccant solution and to heat the air contacting desiccant solution. The heat is provided by a primary energy source such as natural gas or electricity, or a renewable energy source such as solar, waste heat or any combination of these sources. When waste heat from the vapor-compression system is reclaimed, the heat is transferred by heat exchanger means external to the heat exchange surfaces of the vapor-compression system, or by circulating the desiccant throughout the heat exchange surfaces of the vapor-compression system. The desiccant solution is concentrated during this process and falls by gravity to a sump within or below the desorber. Continuous dehumidification is facilitated by pumping the same mass flow rate of desiccant from the sump of the desorber to the sorber as was sent from the sump of the sorber to the desorber.

Hybrid vapor-compression liquid desiccant systems that reclaim waste heat for partial or full generation of the desiccant are more efficient systems than those that use primary energy or alternative energy for regeneration. Furthermore, hybrid vapor-compression liquid desiccant systems that are configured for low-temperature regeneration are more efficient than those systems that regenerate at higher temperatures. Conventional hybrid systems incorporating spray delivery means require higher regeneration temperatures, thereby reducing thermal efficiency of the system. Moreover, conventional hybrid systems which do not combine heat and mass exchange surfaces on a single surface are less efficient and require more operation energy.

SUMMARY OF THE INVENTION

The present invention simultaneously dehumidifies and cools air, using standard vapor-compression equipment and aqueous solutions of liquid desiccants. The invention is a hybrid air-conditioning system embodying a standard compressor, evaporator, condenser, and refrigerant. In addition, liquid desiccant and refrigerant are simultaneously circulated between the evaporator and condenser for cooling and dehumidifying air forced therein. The evaporator and condenser each having a plurality of tubes for receiving circulated refrigerant, and a distribution media for receiving liquid sorbent. Liquid sorbent or desiccant is gravitationally distributed over planar surfaces of fins configured perpendicular to the refrigerant tubes for contact with air forced along the surface of the planar fins.

In operation, warm moist air from, for example a space to be air conditioned, is circulated by a blower through the evaporator. Simultaneously, liquid sorbent and expanded, cooled refrigerant act as dehumidification and cooling agents which convert the warm moist air drawn into the evaporator resulting in cooled dry air expelled back into the conditioned space. The liquid desiccant becomes diluted with water during dehumidification and must be reconcentrated. To accomplish this, a portion of the diluted desiccant is routed through the condenser, whereby thermal heat from the condenser reconcentrates the liquid desiccant which is then recirculated back through the evaporator. The condenser is naturally heated by compressed, hot refrigerant entering the condenser wherein thermal heat cast from the condenser desorbes moisture from the liquid desiccant and expels the moisture from the system via warm moist air exiting the condenser.

The present invention uses aqueous solutions of glycol or brine as the liquid desiccant. Although any form of desiccant solution can be used as long as it can sorb and desorb moisture from the conditioned air without causing undue corrosion to the conditioning equipment. As the liquid desiccant circulates between the cooled evaporator and hot condenser, the chosen desiccant transports thermal energy and moisture and transfers that energy and moisture throughout the hybrid system. The mass transfer characteristics of the liquid desiccant helps maintain a more energy-efficient system. By sorbing rather than condensing moisture from air, the evaporator does not have to be maintained at a temperature below the dew point temperature of the air delivered. Therefore, the temperature of the evaporator can be raised to improve the operating efficiency of the hybrid system. Furthermore, the moisture sorbed by the desiccant solution is circulated to the condenser where it evaporates on contact with a hot condenser causing the condenser to cool. Since the evaporator temperature is raised and the condenser temperature is lowered during operation, higher compressor capacities and coefficients or performance result. The increased efficiencies is a direct product of the circulating diluted/concentrated liquid desiccant. Because of the circulating liquid desiccant, the present invention operates more efficiently and can use down-sized conventional vapor-compression equipment. Along with smaller compressors, and in some cases smaller evaporators and condensers, comes increased efficiency. Finally, because the present system uses biostatic liquid desiccants, the humidity of the conditioned space can be lowered while mitigating the microbial contamination of the air-conditioned space.

Although the present invention is intended to be used as a cooling and dehumidifying air-conditioner, this invention can also be operated with an adiabatic humidifier, adding moisture while cooling the air. During humidification periods, the air provided can be adiabatically saturated and delivered at the same temperature and relative humidity as that obtained from a conventional vapor-compression system. A saturator or humidifier is provided within the air flow path of the evaporator, enabling the consumer to obtain more dehumidification or more cooling by simply flipping a switch. Therefore, the consumer can selectively choose either (1) dehumidification with cooling by enabling the hybrid system without the saturator, or (2) cooling and adiabatic humidification by enabling the hybrid system with the saturator. Because the temperature as well as the humidity level can be selectively controlled by the consumer, it is anticipated that homes in which the present invention are installed will be more comfortable.

Further objects, features, and advantages of the present invention will be apparent from the following detailed description when taken in conjunction with the accompanying drawings.

DETAILED DESCRIPTION OF THE PREFERRED EMBODIMENTS

Figure 1:
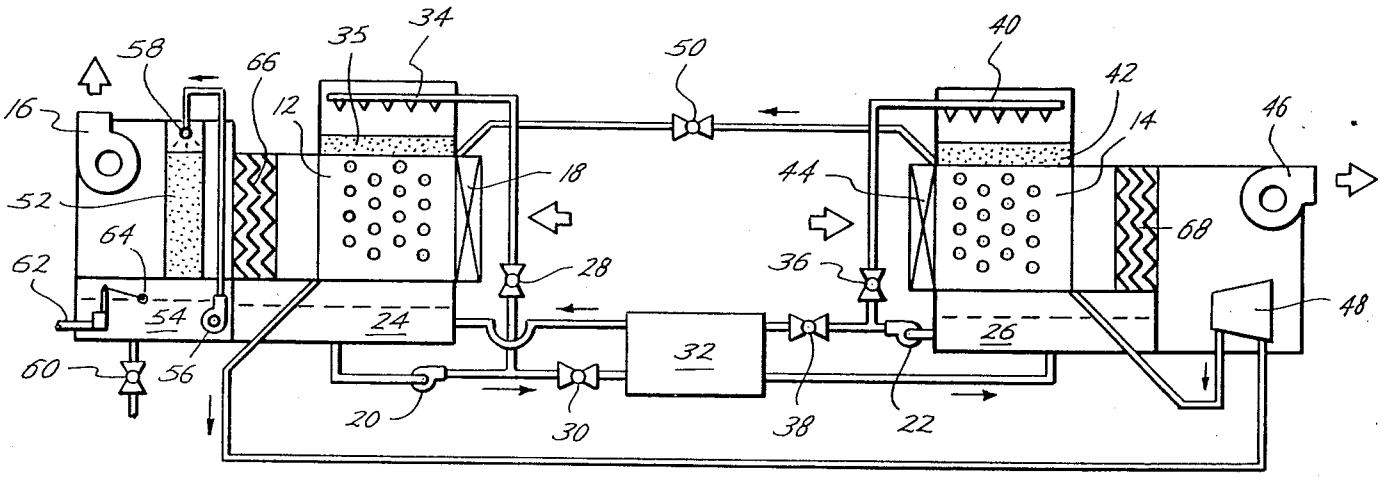
FIG. 1 is a hybrid vapor-compression/liquid desiccant air-conditioning system of the present invention.

Referring to the drawings, FIG. 1 is a hybrid vapor-compression/liquid desiccant air-conditioning system 10 having evaporator 12 and condenser 14. Evaporator blower 16 draws warm moist from, for example, a conditioned air space and into an opening at one end of evaporator 12. As the warm air enters evaporator 12, it is filtered by air filter 18 configured within the air flow path at one end of evaporator 12. As the warm moist air is drawn through evaporator 12, it is cooled and dehumidified by liquid desiccant and refrigerant circulated within evaporator 12.

Liquid desiccant is circulated throughout hybrid system 10, including circulation within evaporator 12 and condenser 14. When hybrid system 10 is activated, evaporator pump 20 and condenser pump 22 operate to simultaneously draw liquid desiccant from evaporator sump 24 and condenser sump 26 respectively. Beginning at evaporator 12, liquid desiccant is pumped from the evaporator sump 24 and, by means of a series of globe valves 28 and 30, liquid desiccant is routed through recuperator 32. Globe valve 30 functions to meter or regulate the amount of liquid desiccant flowing into recuperate 32. Desiccants not pumped into recuperate 32 is metered into desiccant distributor 34 by globe valve 28. The liquid desiccant contained in evaporator sump 24 is diluted with water absorbed by liquid desiccant emitted from desiccant distributor 34 and evenly dispersed throughout evaporator 12 via distribution media 35. Liquid desiccant flows gravitationally downward contacting horizontally forced moist air as it traverses evaporator 12. Thus, the liquid desiccant collects water on its path downward leaving a diluted desiccant solution in evaporator sump 24. To remove the unwanted water from the liquid desiccant, a portion of the diluted desiccant is routed to the condenser sump 26 by globe valve 30. On its way to the condenser sump 26, recuperator 32 thermally heats the diluted desiccant through heat exchange means. The warmed, diluted desiccant is then added to the desiccant within the condenser sump 26. From condenser sump 26, the diluted liquid desiccant is circulated by a condenser pump 22 through globe valves 36 and 38. Globe valve 36 functions to meter a portion of liquid desiccant to desiccant distributor 40. Desiccant distributor 40 then deliver the diluted liquid desiccant to distributor media 42 which evenly distributes the diluted mixture down the hot surfaces of condenser 14. As the diluted mixture contacts the heated surfaces of the condenser 14, moisture is desorbed and the liquid sorbent is reconcentrated as it collects in condenser sump 26. The desorbed water is carried from condenser by scavenger air drawn through air filter 44 and condenser 14 by condenser blower 46. The water is then expelled through warm moist air cast from hybrid system 10. Globe valve 38 delivers the dried, concentrated liquid desiccant back to evaporator sump 24. The concentrated liquid desiccant, routed to evaporator sump 24, helps maintain a moisture sorbing environment which dehumidifies air cast back into the conditioned air space via evaporator blower 16.

To cool the dried conditioned air exiting evaporator 12, a refrigeration loop of a standard vapor-compression system is used. The present invention utilizes conventional vapor-compression equipment (evaporator, condenser, compressor, and refrigerant) incorporated into the aforementioned liquid desiccant circulation system. The present hybrid system 10, using refrigerant (e.g., R22) and having a refrigerant circulation loop comprising a compressor 48 which circulates refrigerant throughout hybrid system 10 between condenser 14 and evaporator 12. Compressor 48 compresses the refrigerant and circulates the compressed refrigerant into condenser 44. Under principles of fluid thermodynamics, the compressed refrigerant remains hot causing condenser 14 to be heated such that diluted desiccant is naturally desorbed with thermal heat generated by compressed refrigerant circulated therein. The condensed refrigerant exits condenser 14 and enters expansion valve 50 whereby the refrigerant is expanded and cooled as it enters evaporator 12. Cooled refrigerant temperatures translate to cool air circulated through evaporator 12. Once the cooled, expanded refrigerant leaves evaporator 12, it is routed back through compressor 48 which transforms the refrigerant to compressed, hot refrigerant ready to again enter condenser 14.

The advantage in combining the liquid desiccant circulation system with the refrigerant circulation system is to maintain a lowered pressure differential throughout the refrigerant system. When the diluted liquid desiccant solution is circulated to condenser 14, water in the solution evaporates on contact with the hot condenser causing condenser 14 to cool. Moreover, since absorption rather than condensation is used by the hybrid system to extract water, evaporator 12 need not be operated at a temperature below dew point. The result is an evaporator 12 operating at a higher temperature and a condenser 14 operating at a lower temperature. Thus, the combined effect is to reduce the temperature difference between the cool evaporator 12 and warm condenser 14 such that the pressure differential within the refrigerant system is minimized. A lower pressure differential allows compressor 48 to operate more efficiently by not having to as much energy compressing the refrigerant. Also, since evaporator 12 need not expend additional energy to cool air below dew point, evaporator 12 operates more efficiently. Thus, the present hybrid system 10 costs less to operate than conventional vapor-compression system. An added benefit of a more efficient operating system is that evaporator 12 and compressor 48 can be down sized, thereby also reducing the initial investment cost of the present invention.

The present invention hybrid system 10 can further reduce the temperature of air supplied to the conditioned space by adding moisture to the air. When air leaving evaporator 12 is dry, but not cool enough to maintain an acceptable temperature within the conditioned space, the air can be humidified with a water saturated humidifying media 52 configured within evaporator air flow path. Humidifying media 52 is made principally of cellulose material and becomes saturated with water by pumping water from humidifier sump 54 by humidifier pump 56. Humidifier pump 56 delivers water into humidifier distributor 58 which in turn evenly distributes the water down humidifying media 52. As water detaches from the bottom of humidifying media 52, it is collected in humidifier sump 54 ready to be recirculated back into the humidifier distributor 58. The humidifying apparatus can be activated or deactivated by simply flipping a switch. If during the operation of the hybrid system 10, the consumer wishes more or less humidity in the air, he or she can activate or deactivate the humidifying system independent of the hybrid system 10. Water can be periodically flushed from the humidifier sump 54 through globe valve 60. A makeup line 62 with shut-off float control 64, is used to refill the humidifier sump 54 with fresh water free of microbial contamination.

Humidifying media 52 is placed between evaporator blower 16 and evaporator entrainment separator 66. Evaporator entrainment separator 66 functions to entrap liquid desiccant entrained in the evaporator 12 air flow path. As cool dry air contacts evaporative entrainment separator 66, the liquid desiccant is collected upon the surface of entrainment separator 66. As liquid desiccant collects upon the surface it is gravitationally drawn downward and deposited in the evaporator sump 24 for recirculating back into the system. Condenser entrainment separator 68 functions similar to evaporator entrainment separator 66. By collecting and depositing liquid desiccant into the condenser sump 26, the condenser entrainment separator 68 assures that minimal amounts of costly liquid desiccant leave the hybrid system 10. Likewise, evaporator entrainment separator 66 insures that minimal amounts of liquid desiccant are circulated within the conditioned air space. In small concentrations, the type of liquid desiccant chosen for the presentation invention is relatively nontoxic. Evaporator entrainment separator 66 ensures that high concentration levels in the air conditioned space will never be achieved.

The present invention uses an aqueous solution of glycol or brine as the liquid desiccant. Although triethelyne glycol or calcium chloride is preferred, other forms of liquid desiccant can also be used, including, e.g., lithium chloride and lithium bromine. Each form of liquid desiccant having its own advantages and disadvantages. When considering which form to use, factors such as safety, corrosivity, heat and mass transfer potential, and cost must be considered. Table I represents a weighted summary of all four forms based on the above factors.

TABLE I

| Characteristic (Max Weight) | LiCl | LiBr | $CaCl_2$ | TEG |
|---|---|---|---|---|
| Safety(1.0) | 7.0 | 8.0 | 9.0 | 10.0 |
| Corrosion(0.8) | 8.0 | 8.0 | 7.2 | 8.0 |
| Mass Transfer potential(0.8) | 8.0 | 8.0 | 8.0 | 8.0 |
| Heat of mixing(0.6) | 4.2 | 5.4 | 4.8 | 6.0 |
| Cost(0.5) | 3.5 | 2.5 | 5.0 | 4.5 |
| Heat transfer potential(0.5) | 5.0 | 4.5 | 5.0 | 2.5 |
| Parasitic power losses(0.3) | 3.0 | 3.0 | 2.7 | 2.5 |

TABLE I-continued

| Characteristic (Max Weight) | LiCl | LiBr | $CaCl_2$ | TEG |
|---|---|---|---|---|
| Total | 38.7 | 39.4 | 41.7 | 40.5 |

Safety is a factor since the liquid desiccant will be in direct contact with the air delivered to the conditioned space. Therefore, a liquid desiccant must be chosen which will not demonstrate adverse effects of ingestion, inhalation or skin contact. All four forms are relatively nontoxic with triethelyene glycol being the least toxic of the group. Corrosive liquid desiccant should be avoided so as to maintain longevity and reliable operation of the present invention. Corrosion rates in inhibited triethelyene glycol, are low for most metal surfaces including aluminum, copper, and steel. The thermal conductivity of the liquid desiccant solution is representative of its heat transfer potential. The liquid desiccant must be capable of transferring heat fairly quickly as the desiccant circulates between the cooled evaporator and heated condenser. Thermal conductivity of calcium chloride and lithium chloride are somewhat better than the other forms. Mass transfer of all four forms is relatively equal. Costs of the four forms of desiccant range from cheaper calcium chloride and lithium chloride to the more expensive lithium bromide.

Figure 2:
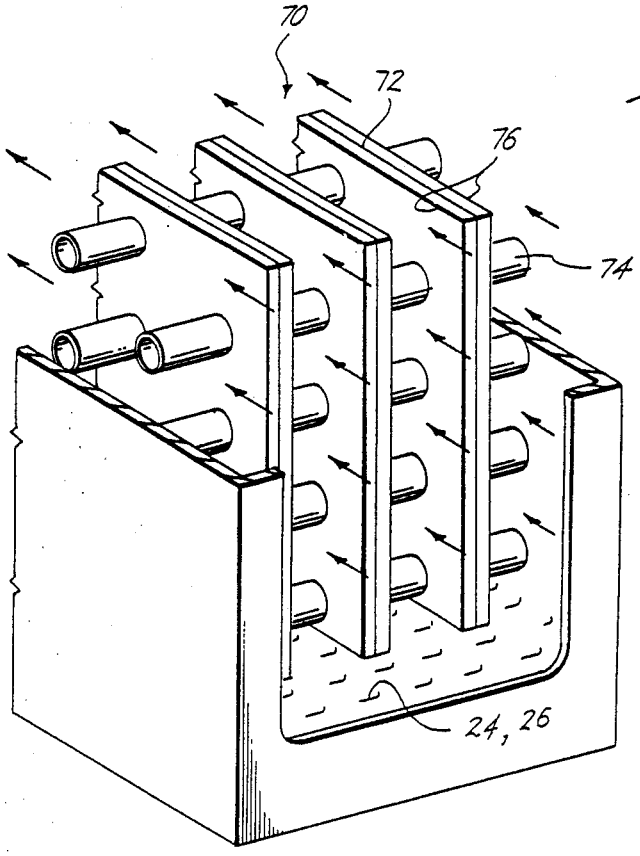
FIG. 2 is a cut-away view of a heat and mass exchanger apparatus housed within a condenser or evaporator of the present invention.

Contained within evaporator 12 and condenser 14 is a heat and mass exchanger 70 illustrated in FIG. 2. FIG. 2 is cut-away view of the exchanger 70 comprising a plurality of planar fins 72 and refrigerant tubes 74. Liquid desiccant is dispersed evenly on the top of exchanger 70 via distribution media 35 or 42 illustrated in FIG. 1. Liquid desiccant flows as thin falling films 76 on both sides of the planar surfaces of each fin 72. Each fin 72 is spaced equal distance from the adjacent fin to allow air movement along the wetted planar surfaces. By placing the exchanger 70 directly within the air flow path and configuring the planar surface of each fin parallel to said air flow path, efficient heat and mass transfer is achieved. The fins 72 can be either cooled or heated by cold or hot refrigerant circulated throughout the refrigerant tubes 74 traversing each fin. Because of the larger area of fins 72, the temperature of fins 72 and the vapor pressure of water in the falling films 76 can be rapidly and efficiently transferred to air entering exchanger 70. Both the fins 72 and refrigerant tubes 74 are made of non corrosive material such as copper which will not degrade when brought in contact with liquid sorbent and water flowing downward and across the outside surfaces of fins 72 and refrigerant tube 74. The downward flowing liquid desiccant is collected in evaporator sump 24 or condenser sump 26 for reuse in the system.

Figure 3:
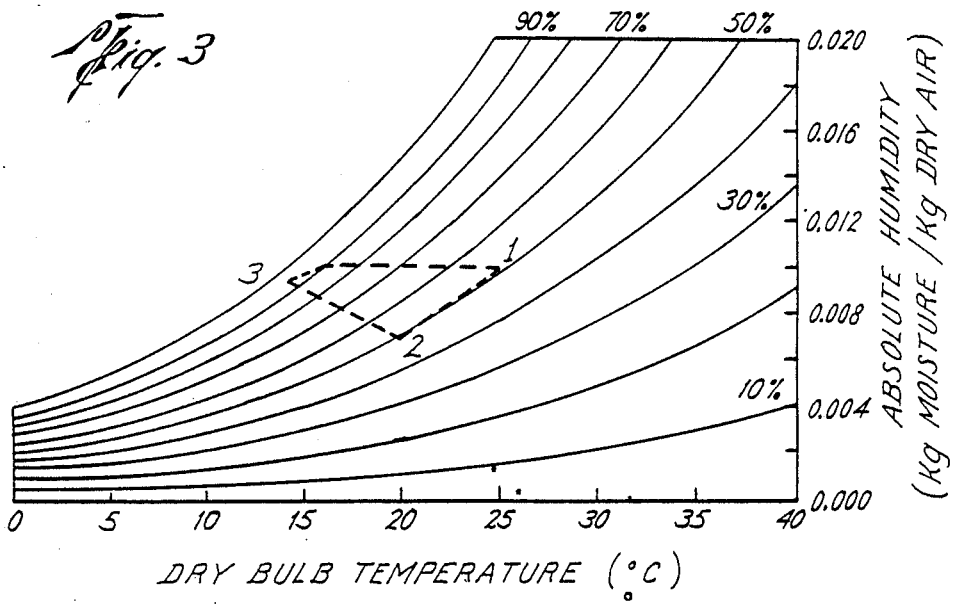
FIG. 3 is a graph of dry bulb temperature versus absolute and relative humidity showing a vapor-compression/dehumidification cooling cycle, and a vapor-compression/dehumidification cycle with adiabatic humidification.

FIG. 3 illustrates the process paths of the conditioned air in the disclosed invention versus the process path of the conventional vapor-compression air conditioner. The graph of FIG. 3 is taken using 26.7° C. air at 50% relative humidity as the benchmark. The conditioning of air by a conventional vapor-compression air condition is shown by path 1-3. Dry bulb temperature as well as absolute humidity, is reduced by standard vapor-compression techniques incorporating condensation dehumidifying techniques. In order to condense the moisture prior to removal, it is necessary to cool the air to a point below dew point, such dew point temperature being lower than the desired temperature of point 3. A lower condensation temperature of the evaporator refrigerant requires additional work to be done by the compressor of a conventional vapor-compression system. Thus, to arrive at point 3, a conventional air conditioning system must cool the air below that shown in point 3, and then a reheating process is sometimes used to bring dry bulb temperature back to point 3. The supercooling and reheating process is very inefficient and demonstrates lower coefficients of performance. On the other hand, conditioning of air in the hybrid system 10 of the present invention is represented by path 1-2 with the humidifier pump 56 not activated, and by path 1-2-3 if the humidifier pump 56 is activated. By simply flipping a switch, humidifier pump 56 can be turned off thereby providing dry cool air along path 1-2. Absolute humidity is reduced by the liquid desiccant sorption process. The air need not be supercooled as in the conventional dehumidification-by-condsensation process of conventional air conditioners. If the consumer wants cooler humidified air, he or she can simply flip a switch at any time during hybrid system 10 operation, thereby activating humidifier pump 56. An activated humidifier pump 56 functions to add moisture to the cool dry air along path 2-3. Thus, the same temperature and relative humidity at point 3 can be selectively obtained from the hybrid system 10 as from a conventional air conditioning system but without having to supercool the air and thereby wasting energy.

While the present invention has been described with reference to a preferred embodiment, one of ordinary skill in the art will appreciate that additions, modifications, or deletions can be made without departing from the scope of the invention.

What is claimed is:

1. A hybrid air conditioning system comprising:

a refrigerant;

a liquid desiccant;

an evaporator for receiving liquid desiccant, refrigerant, and warm moist air, and for absorbing moisture to the liquid desiccant and expelling the liquid desiccant, the refrigerant, and cool dry air:

a condenser for receiving liquid desiccant, refrigerant, and dry air, and for desorbing moisture from the liquid desiccant and expelling hot moist air, liquid desiccant, and refrigerant;

each of said evaporator and condenser having a heat and mass exchanger comprising:

(I) a plurality of horizontally extending refrigerant tubes extending the length of said condenser or evaporator through which refrigerant is circulated;

(II) a plurality of substantially planar fins extending the height of said condenser or evaporator, the planar surface of each fin being perpendicularly traversed by said plurality of refrigerant tubes;

(III) a horizontal air flow path extending perpendicular to said horizontally extending refrigerant tubes and along the planar surface of each said planar fin;

(IV) a distribution media configured above said refrigerant tubes and said fins for distributing said liquid desiccant vertically down and across the surface of said fins;

(V) a sump configured below said refrigerant tubes and said fins for receiving downward flowing liquid desiccant;

means for circulating said refrigerant within the horizontally extending refrigerant tubes and between said condenser and evaporator; and means for pumping said liquid desiccant within said evaporator and within said condenser and between the sump of said evaporator and the sump of said condenser.

2. The hybrid air conditioning system of claim 1, wherein said distribution media configured to gravitationally deliver liquid desiccant downward and perpendicular to said horizontal air flow path.

3. The hybrid air conditioning system of claim 1, wherein said refrigerant is circulated between said evaporator and said condenser by a compressor.

4. The hybrid air conditioning system of claim 1, wherein liquid desiccant in the sump of said evaporator is partially distributed to the distribution media of said evaporator and partially distributed to the sump of said condenser.

5. The hybrid air conditioning system of claim 1, wherein liquid desiccant in the sump of said condenser is partially distributed to the distribution media of said condenser and partially distributed to the sump of said evaporator.

6. The hybrid air conditioning system of claim 1, wherein said refrigerant tubes and planar fins constructed of corrosion resistant materials with acceptable heat transfer characteristics.

7. A hybrid air conditioning system comprising:

a refrigerant;

a liquid desiccant;

an evaporator for receiving liquid desiccant, refrigerant, and warm moist air, and for expelling the liquid desiccant, refrigerant, and cool dry air, said evaporator including a first heat and mass exchanger;

first entrainment separator means for capturing liquid desiccant suspended in the cool dry air expelled from said evaporator;

a condenser for receiving liquid desiccant, refrigerant, and dry air, and for expelling liquid desiccant, refrigerant, and hot moist air, said condenser including a second heat and mass exchanger;

second entrainment separator means for capturing liquid desiccant suspending in the hot moist air expelled from said condenser;

evaporator blower means for drawing warm moist air into one end of said evaporator to contact with said first heat and mass exchanger and for drawing dry cool air from opposite end of said evaporator;

condenser blower means for drawing dry air into one end of said condenser to contact with said second heat and mass exchanger and for drawing hot moist air from an opposite end of said condenser;

a first and second sump for collecting liquid desiccant captured by said first and second entrainment separator means respectively;

a distribution means for distributing liquid desiccants down and across the surfaces of said first and second heat exchangers whereby said liquid desiccant is collected in first and second sumps, respectively;

means for circulating said refrigerant between said evaporator and condenser; and means for pumping said desiccant within and between said evaporator and condenser.

8. The hybrid air conditioning system of claim 7, wherein said evaporator blower means comprises:

an evaporator housing defining a primary air flow path through said evaporator from a first opening placed at one side of said evaporator and through a second opening placed at the opposite side of said evaporator, said warm moist air entering said first orifice and said cool dry air exiting said second opening;

a fan mechanism placed within said primary air flow path configured near the second opening, said first entrainment separator means being placed within said air flow path between said second opening and said fan mechanism.

9. The hybrid air conditioning system of claim 7, wherein said condenser blower means comprises:

a condenser housing defining a secondary air flow path through said condenser from a first opening placed at one side of said condenser to a second opening placed at the opposite side of said condenser, said dry air entering said first opening and said hot moist air exiting said second opening;

a fan mechanism placed within said air flow path configured near the second opening, said second entrainment separator means being placed within said air flow path between said second opening and said fan mechanism.

10. A hybrid air conditioning system comprising:

a refrigerant;

a liquid desiccant;

an evaporator for receiving liquid desiccant, refrigerant, and warm moist air, and for expelling liquid desiccant, refrigerant, and cool dry air;

an evaporator housing having a first and second opening defining a horizontal evaporator air flow path through said evaporator;

a first fan mechanism placed within said evaporator air flow path near said second opening for horizontally drawing warm moist air into the evaporator at said first opening and for horizontally drawing cool dry air from the evaporator at said second opening;

a first entrainment separator configured within said evaporator air flow path near said second opening, said first entrainment separator having means for separating liquid desiccant from air within said evaporator air flow path;

a humidifier configured within said evaporator air flow path between said first entrainment separator and said first fan mechanism, said humidifier having means for adding moisture to air within the horizontal evaporator air flow path;

a condenser for receiving liquid desiccant, refrigerant, and dry air, and for expelling liquid desiccant, refrigerant, and hot moist air;

a condenser housing having a first and second opening defining a horizontal condenser air flow path through said condenser;

a second fan mechanism placed within said condenser air flow path near said second opening for horizontally drawing dry air into the condenser at said first opening and for horizontally drawing hot moist air from the condenser at said second opening;

a second entrainment separator configured within said condenser air flow path near said condenser, said second entrainment separator having means for separating liquid desiccant from air within said condenser air flow path;

each of said evaporator and condenser having a heat and mass exchanger comprising:

(I) a plurality of horizontally extending refrigerant tubes extending the length of said condenser or evaporator through which refrigerant is circulated;

(II) a plurality of substantially planar fins extending the height of said condenser or evaporator, the planar surface of each fin being perpendicularly traversed by said plurality of refrigerant tubes;

(III) a horizontal air flow path extending perpendicular to said horizontally extending refrigerant tubes and along the planar surface of each said planar fin;

(IV) a distribution media configured above said refrigerant tubes and said fins for distributing said liquid desiccant vertically down and across the surface of said fins;

(V) a sump configured below said refrigerant tubes and said fins for receiving downward flowing liquid desiccant;

means for circulating said refrigerant within the horizontally extending refrigerant tubes and between said condenser and evaporator; and means for pumping said liquid desiccant within said evaporator and within said condenser and between the sump of said evaporator and the sump of said condenser.

11. The hybrid system of claim 10, said humidifier comprising:

a humidifying media through which water is distributed;

water distribution means for distributing water to a top of said humidifying media;

a water sump for collecting water runoff from the bottom of said humidifying media;

a pumping mechanism configured to deliver water from said water sump to said water distribution means.

12. The hybrid system of claim 11, wherein said humidifying media is constructed of an air and water porous material.

13. A process for converting warm moist air into cool dry air comprising the steps of:

providing compressed and expanded refrigerant;

providing absorbing, concentrated liquid desiccant and desorbing, diluted liquid desiccant;

passing air in contact with said absorbing, concentrated liquid desiccant and in simultaneous thermal contact with said expanded refrigerant to produce cool dry air, desorbing, diluted liquid desiccant and warm expanded refrigerant;

passing air in contact with said desorbing, diluted liquid desiccant and in simultaneous thermal contact with said compressed refrigerant to produce warm moist air, absorbing, concentrated liquid desiccant and cooled compressed refrigerant;

circulative said absorbing, concentrated and desorbing, diluted liquid desiccants;

compressing said expanded refrigerant to produce said compressed refrigerant;

expanding said compressed refrigerant to produced said expanded refrigerant; and selectively humidifying said cool dry air.

* * * * *

UNITED STATES PATENT AND TRADEMARK OFFICE

CERTIFICATE OF CORRECTION

PATENT NO. : 4,941,324

DATED : July 17, 1990

INVENTOR(S) : Peterson et al.

It is certified that error appears in the above—identified patent and that said Letters Patent is hereby corrected as shown below:

N THE SPECIFICATION:

In column 2, line 6, delete --heat-- and insert "mass".

In column 2, line 10, insert the word "is" after --egeneration-- and before the word --accomplished--.

In column 3, line 41, delete --or-- and insert "of".

In column 4, line 26, insert the word "air" after --moist-- and before the word --from--.

In column 4, line 45, delete --recuperate-- and insert recuperator".

In column 4, line 64, delete --36-- and insert "38".

In column 4, line 66, delete --deliver-- and insert 'delivers".

In column 5, line 10, after the word --The-- and before the vord --concentrated-- insert the word "cool".

In column 5, line 57, after the word --to-- and before the vord --as--, insert the word "expend".

UNITED STATES PATENT AND TRADEMARK OFFICE

CERTIFICATE OF CORRECTION

PATENT NO. : 4,941,324
DATED : July 17, 1990
INVENTOR(S) : Peterson et al.

It is certified that error appears in the above—identified patent and that said Letters Patent is hereby corrected as shown below:

IN THE CLAIMS:

In claim 8, line 2, column 10, delete --orifice-- and insert 'opening".

In claim 13, line 23, column 12, delete --cooled-- and insert "cool".

In claim 13, line 24, column 12, delete --circulative-- and insert "circulating".

Signed and Sealed this

Seventeenth Day of September, 1991

*Attest:*

HARRY F. MANBECK, JR.

*Attesting Officer*

*Commissioner of Patents and Trademarks*